US006419226B2

(12) United States Patent
Krise et al.

(10) Patent No.: US 6,419,226 B2
(45) **Date of Patent: *Jul. 16, 2002**

(54) DROP SLOT GAME MACHINE

(75) Inventors: David A. Krise; Randy D. Sines, both of Spokane, WA (US)

(73) Assignee: Digideal Corporation, Spokane, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/813,518

(22) Filed: Mar. 20, 2001

Related U.S. Application Data

(63) Continuation of application No. 09/128,218, filed on Aug. 3, 1998, now Pat. No. 6,203,008, which is a continuation of application No. 08/649,821, filed on May 17, 1996, now Pat. No. 5,788,230.

(51) Int. Cl.[7] ..... A63D 3/02
(52) U.S. Cl. ..... 273/121
(58) Field of Search ..... 273/118 R, 118 A, 273/118 D, 119 R, 119 A, 121 R, 121 A, 121 B, 138.1, 143, 120 A

(56) References Cited

U.S. PATENT DOCUMENTS

| | | | | |
|---|---|---|---|---|
| 3,383,111 A | | 5/1968 | Lucas | |
| 4,508,336 A | | 4/1985 | Yokoi | |
| 5,016,879 A | | 5/1991 | Parker et al. | |
| 5,120,060 A | | 6/1992 | Parker et al. | |
| 5,121,919 A | | 6/1992 | Martti | |
| 5,421,576 A | | 6/1995 | Yamazaki et al. | |
| 5,462,277 A | | 10/1995 | Takemoto | |
| 5,788,230 A | | 8/1998 | Krise et al. | |
| 6,047,963 A | | 4/2000 | Pierce et al. | |
| 6,139,013 A | | 10/2000 | Pierce et al. | |
| 6,203,008 B1 | * | 3/2001 | Krise et al. | 273/121 B |
| 6,220,593 B1 | | 4/2001 | Pierce et al. | |

FOREIGN PATENT DOCUMENTS

| | | |
|---|---|---|
| JP | 6-269536 | 9/1994 |

* cited by examiner

*Primary Examiner*—Raleigh W. Chiu
(74) *Attorney, Agent, or Firm*—Wells St. John P.S.

(57) ABSTRACT

The present invention is a game machine comprising a playing field having an upper interior edge and a lower interior edge with at least one drop zone deflector located adjacent to the upper interior edge of the playing field. The present invention also has a number of exit positions located along the lower interior edge of the playing field. A payline display and a payline symbol selector display are also part of the present invention. Balls passing through the exit positions select symbols for display in the payline display determined in part upon the movement of a ball on said playing field. The game also has a ball ejector capable of propelling a ball in a path that intersects the drop zone deflector.

25 Claims, 5 Drawing Sheets

1
2
3
4
38
1
2
BAR
7
64
4
7
7
60
1
2
3
4
36
62

DROP SLOT GAME MACHINE

This is a continuation of U.S. patent application Ser. No. 09/128,218, filed Aug. 3, 1998, now U.S. Pat. No. 6,203,008 issued Mar. 20, 2001, which is a continuation of prior U.S. patent application Ser. No. 08/649,821, filed May 17, 1996 (U.S. Pat. No. 5,788,230 issued Aug. 4, 1998). Priority under 35 U.S.C. § 120 is claimed with regard to said prior application. Said prior applications are also incorporated by reference hereinto in their entirety.

FIELD OF THE INVENTION

The present invention relates generally to an electromechanical gaming machine, and more particularly to a combination slot machine and pachenko game machine which has drop zones created by zone deflectors and scoring positions which vary from game to game.

BACKGROUND OF THE INVENTION

Slot machines have been a dominant part of the gaming industry world wide for over 50 years. While pachenko machines have seen a great deal of popularity in Asia, they are not as well suited for gaming as the traditional slot machine.

Slot machines have changed very little over the years. Whether mechanical or electronic, they still have reels spinning and coming to sop on a potential jackpot. It appears that a large part of the appeal of slot machines is the "mechanical" nature of the spinning reels which induces a belief in players that they are witnessing a truly random event and that the "big" jackpot is always just around the corner. While the big jackpot may or may not be just around the corner, slot machines maintain a very accurate payout percentage, usually between 92 and 99 percent with the house retaining the rest as profit.

The public perception of the "mechanical" nature of a slot machine is a critical part of their acceptance of the fairness of the machine. When slot machines with video displays showing simulated reels were introduced, the public rejected them in favor of the older slot machines with mechanical reels. Even though the new machines simulated the mechanical slots in every way and used the same random number generating circuit and yielded the same percentages as the mechanical slot machines, they were less attractive to the gaming public.

The biggest problem with the mechanical or electronic slot machines that have mechanical reels is that they have higher mechanical maintenance costs than machines with video displays in place of spinning reels. While prior art machines that replaced the spinning reels with video displays had lower mechanical maintenance costs they were also less attractive to gamers.

Another problem with traditional slot machines is their size, due to the space requirements of the mechanical reels. Traditional slot machines take up a great deal of floor space and are generally not well suited to being wall mounted. Smaller machines would allow the machines' owners to generate more revenue per square foot. The option of wall mounting a machine is attractive because this allows greater flexibility in the placement of machines.

Yet another problem with traditional slot machines is the limited number of possible combinations of symbols limits the size of a jackpot that can be offered. In order to provide larger jackpots, gaming establishments link multiple machines together in order to offer a progressive jackpot.

Finally, the very randomness which makes slot machines attractive also deters some people from playing them because they do not perceive there to be any skill involved in playing the game. Additionally, some people are looking for a more interactive experience than is provided by traditional slot machines. Too much interactivity, such as that involved with video and pinball games, would slow down the cycle rate of the machines to an unacceptable level.

There is a demand for a gaming machine that is as attractive to gamers a slot machines but at lower mechanical maintenance costs. There is a further demand for a gaming machine which would allow for the chance at a large jackpot with a small investment without having to link together multiple machines. There is yet a further demand for a gaming machine which creates a perception of skill while maintaining an accurate payout percentage and a fast cycle rate.

SUMMARY OF THE INVENTION

The present invention is a drop slot game machine that utilizes falling balls which drop from the upper part of the playing field, which is divided into user or randomly selectable drop zones, and into exit positions at the bottom of the playing field. The balls encounter deflector pegs which randomly change the path of the balls during their fall. As each passes through an exit position it is detected by sensor (photoelectric, infra-red, etc). Each exit position has a corresponding symbol which is represented on a liquid crystal display, the exit position symbol display, which lights up when a ball passes through that position. A small LED above each symbol reflects how many balls fell into a particular position (providing some did) so there can be no doubt to the player to which position and to how many balls passed through the associated exit position. A larger LCD payline display, simulating the payline of a traditional slot machine, shows the series of symbols selected by the balls passing through the exit positions.

If, for example, three balls are dropped, then the symbols representing the three exit positions which the balls pass through are displayed on the larger payline display. The symbols used in traditional slot machines as well as new symbols can be displayed on the exit position symbol display and the payline display. If all three balls fall into a single exit position, then the same symbol will be represented three times on the payline.

Payout in the present invention is controlled by electrical circuits similar to the those controlling payout in traditional slot machines, thereby ensuring the same payout percentages.

After passing through the exit positions, the balls recirculate by rolling into a launching position where they will be ejected back to the top of the game machine to drop through the playing field. It is likely that the balls will be launched by electrical solenoid or pneumatic ejector system.

A microprocessor/random number generator determines which symbols appear on which exit positions at the time of each pull. More than three balls can be used and more than three symbols can be represented on the payline (such as a four or greater reel machine). furthermore, multiple paylines can be used using the appropriate number of balls (i.e. three paylines, three symbols per payline, nine balls would drop). In general, it is possible to simulate almost all current slot machine pay variations.

An additional feature of the machine is to have drop zones so that the balls may be deflected into one specific zone at the upper starting position. These zones may be either randomly selected by the machine itself, or selected by the player just prior to the symbols being shown on the LCD.

Other features may include bonus payouts such as: symbols designated by the LCD as "double", "triple" etc. if balls fall in those individual or group of holes. Another bonus may be available if all the balls fall through the same hole. Yet another bonus may be available based upon what is displayed on the exit position display in combination with the payline display.

From a players standpoint, there is an element of anticipation not present in traditional slot machines. A player can see a jackpot developing and "wish" balls into the jackpot positions. The present invention also creates a perception of "true" randomness not found in traditional slot machines. The player sees balls freely dropping through the playing field as opposed to reels jerkily moving symbols in or out of the payline.

The present invention also creates a perception of skill, by being able to select drop zones, a player can exert a distinct influence on the outcome (not at all present in current slot machines). In reality, the percentages will run the same, but there is little doubt that the perception of skill on the player's behalf will exist.

Another aspect that is unique to the present invention is what may be called the "if only I had" aspect which is evident in other gambling sport/games, i.e. horse racing "if only I had bet on the number two horse", roulette "if only I had bet the red or seven", craps, etc. In the case of the present invention, "if only I had selected number two drop zone".

Yet another advantage to the player is their ability to experience the excitement of a "high probability of win" round when they look down and see many symbols which may be "high" jackpot oriented. In these cases, the player will actually be at an advantage to win during that round, and he/she will know it. This situation never exists on a traditional slot machine.

The machine of the present invention also allows for a greater number of symbols to be displayed than a traditional, reel based, slot machine. The reel based machines are limited to displaying the number of symbols that can be fit on the reel. In a three(3) reel machine with eleven(11) symbols per reel there are 1331 possible combinations that can ever be displayed on the payline. In the present invention it is easy to store many symbols for electronic display. In a machine with eight(8) exit positions and 25 possible symbols per exit position there are over 150 billion combinations for display on the exit position display. This larger number of possible combinations makes it possible for the present invention to payout over a larger range of combinations and would allow a single machine to have the potential to payout a very large jackpot.

The present invention should have a very wide appeal to the gaming establishments as it has an overtly visible "mechanical" element, balls launching and freely dropping through the playing field, yet very low maintenance. The maintenance is low because other than simple mechanical switches and a ball ejecting system, the machine is dependent on non-mechanical hardware and software for most of its operation.

These and other features of the present invention will be more fully appreciated when considered in light of the following detailed description and drawings.

Figure 1:
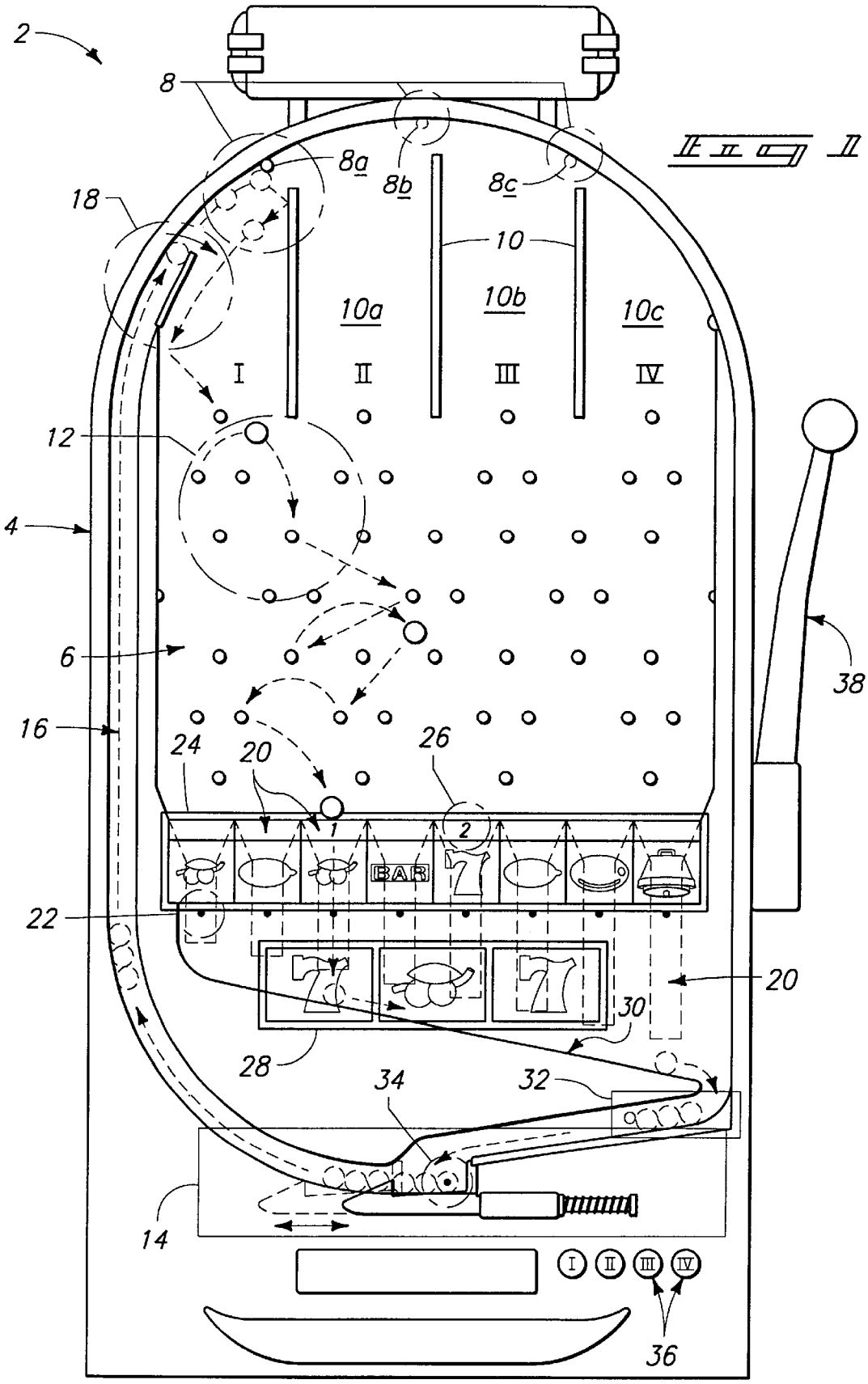
FIG. 1 is a functional diagram of the drop slot game machine of the present invention.

The game machine of the present invention is shown generally at 2 in FIG. 1. The present invention comprises a generally upright gaming cabinet 4, the upper portion of which houses the playing field 6 which in turn is covered by a transparent front glass 44. The playing field is inclined, more preferably vertical, sot hat the balls may fall under the force of gravity. At the top of playing field 6, there are three zone deflectors 8*a*, 8*b*, and 8*c*, just below and slightly to the right of each deflector there is a zone divider wall 10*a*, 10*b*, and 10*c*. Zone deflectors 8*a*, 8*b*, and 8*c* along with zone divider walls 10*a*, 10*b*, and 10*c* divide the upper portion of the playing field into drop zones I, II, III and IV.

The middle portion of playing field 6 is comprised of a maze of deflector pegs 12. Generally, the maze of deflector pegs 12 is arranged so it would take a ball 2–4 seconds to fall through the maze. There are eight exit positions 20 at the bottom of playing field 6 under the maze of deflector pegs 12. Each exit position 20 has an exit position sensor 22 associated with it and each exit position sensor 22 has an exit portion symbol display 24 associated with it. Each exit position symbol display 24 is also comprised of a ball count display 26. Beneath the exit position symbol display 24, there is a payline display 28.

The exit positions 20 lead to ball return ramp 30 which in turn leads to ball holder 32 which is connected to ball ejector 14. Ball ejector 14 is provided with a ball ejector sensor 34 that will cause the ball holder 32 to load the ball ejector 14 when no balls are detected.

The drop slot game machine 2 is also provided with four zone select buttons 36 and a play handle 38. The player may use the zone select buttons 36 to chose which zone the balls should drop into when launched by the ball ejector 14. Play handle 38 is modeled after a traditional slot machine handle.

Figure 2:
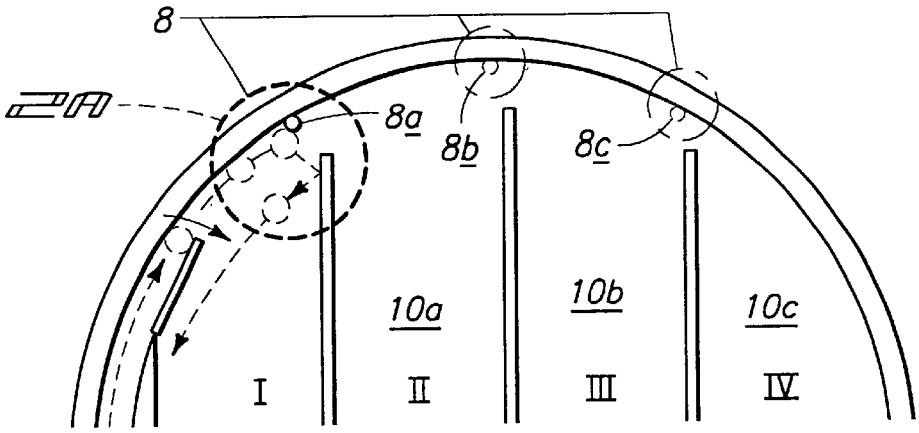
FIG. 2 is a functional diagram of the upper portion of the playing field of the present invention.
Figure 2A:
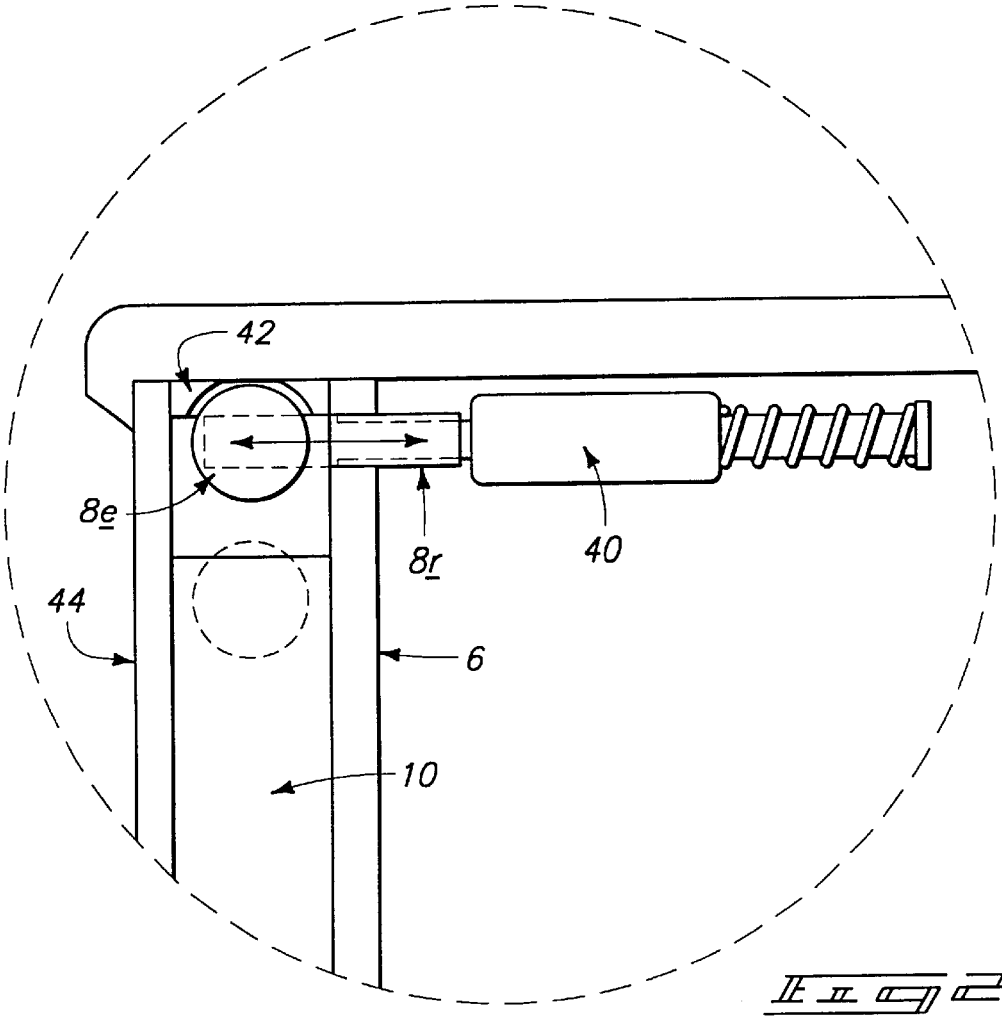
FIG. 2*a* illustrates a close up cutaway cross-sectional view of a portion of FIG. 2.

FIG. 2 illustrates the drop zone portion of the present invention. Referring to FIG. 2*a*, we can see that zone deflectors 8 have two positions, retracted 8*r*, and extended 8*e*. When extended, there is not enough room for a ball to pass between zone deflector 8*e* and zone divider wall 10. Front glass 44 and playing field 6 also limit the ball's travel. In addition, the upper interior edge 42 of playing field 6 is curved in order to guide the ball along a path intersecting the deflectors 8*e*. The extension and retraction of the zone deflectors is controlled by deflector peg retractor/extender 40 which is a solenoid in one of the preferred embodiments.

Figure 3:
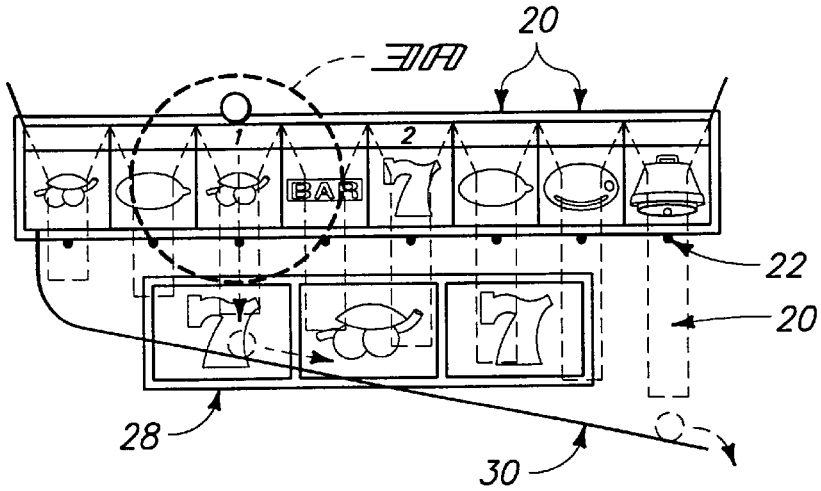
FIG. 3 illustrates the exit positions, payline display, and symbols elector display of the present invention in isolation.
Figure 3A:
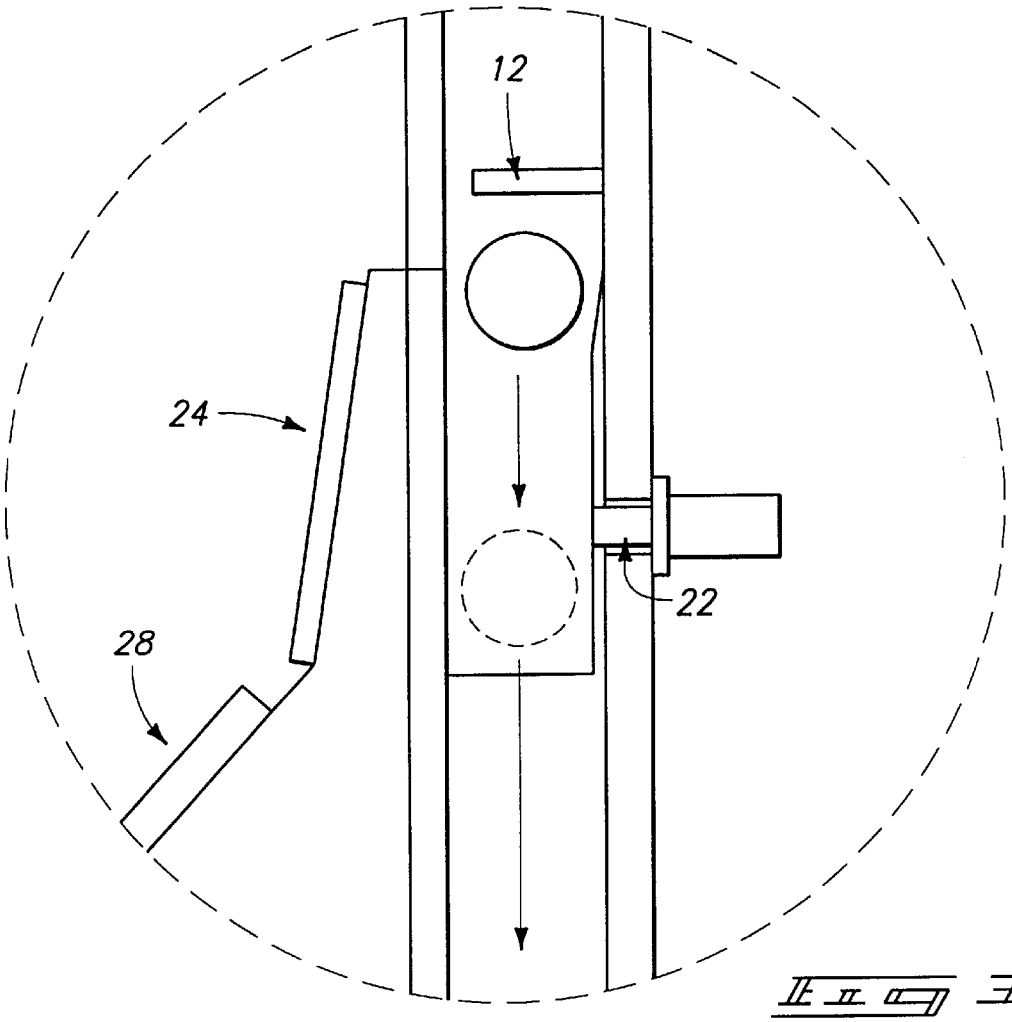
FIG. 3*a* is a cross-sectional close up of a portion of FIG. 3.

FIGS. 3 and 3*a* illustrate a front and side view of the exit positions 20. In FIG. 3*a* deflector peg 12, exit position sensor 22, and exit position symbol display 24, and payline display 28 can be clearly seen. In the present preferred embodiment, exit position sensor 22 is an infra-red (IR) sensor. The IR sensor 22 detects a ball passing through the exit position 20 and illuminates the corresponding symbol on the exit position symbol display 24 and payline display 28.

Figure 4:
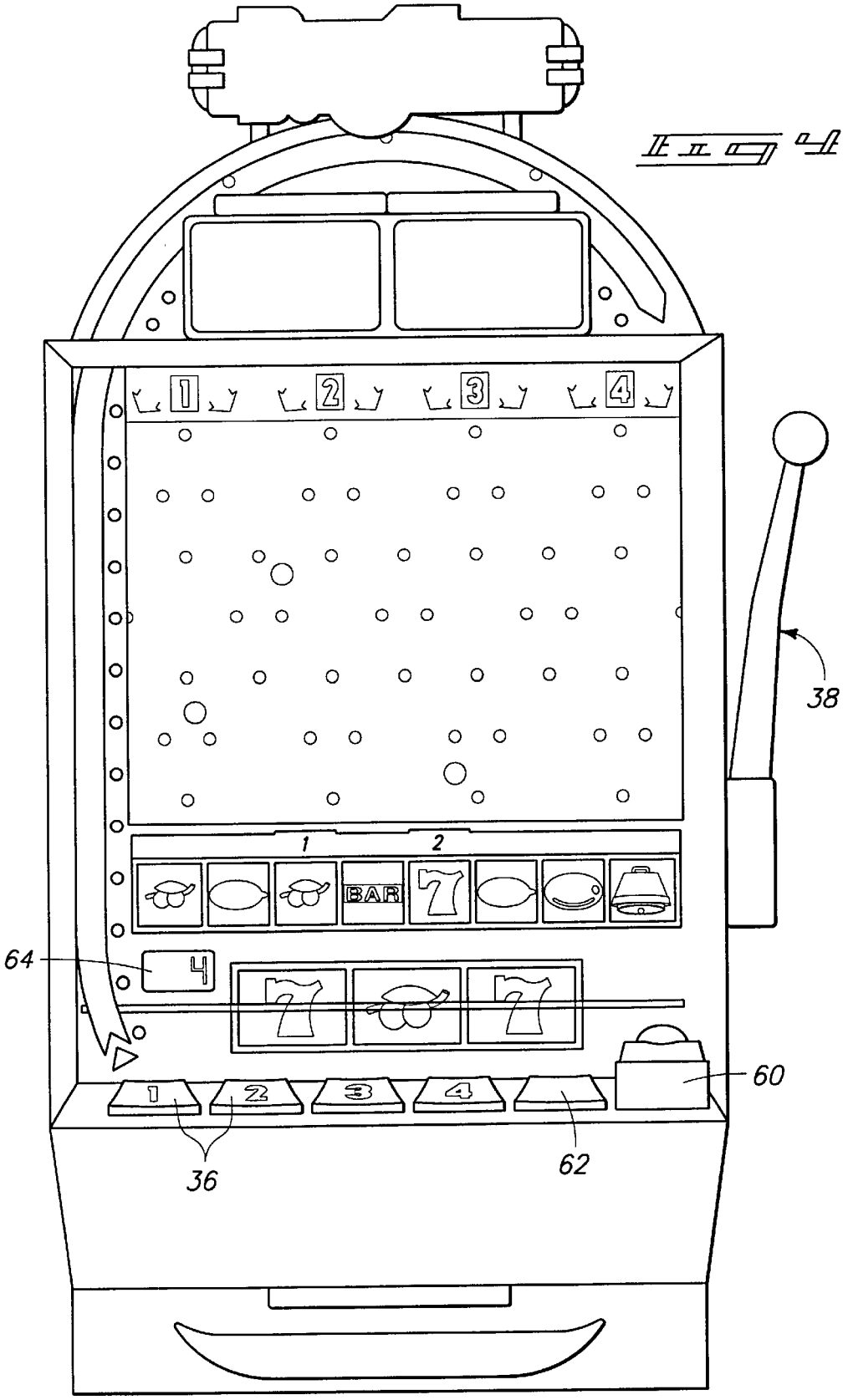
FIG. 4 is an isometric view of the game machine of the present invention.

Referring to FIG. 4, in a typical playing cycle the player will put coins in the machine at coin input or receptacle 60, or play existing credits indicated by credit display 64, the same as regular slot machines. At this point all LCDs go blank. The player then hits a drop zone button 36 once and new symbols are selected and displayed on the exit position symbol display 24. The player can now pull the traditional slot machine handle 38 or push a play button 62 or a zone select button 36 again to launch the balls along a path of travel 16 shown in FIG. 1. Upon first push of a zone select button 36, a zone deflector 8 is also activated and moves into an extended position 8*e*.

A separate play button 62 will exist for people who just want to put their money in and push a button, allowing play similar to traditional slot machines. Alternatively, people may put their money in and pull the handle 38. In these cases the zone will be selected randomly by the machine itself. As soon as this button is pushed, or handle pulled, the symbols are immediately selected and displayed on the exit position symbol display 24 and the ball is launched (perhaps simultaneously). Balls are launched, deflected into zones selected or random, fall and drop into holes and appropriate symbols are displayed on the payline display 28. Balls proceed to launch positions for next pull or launch. If the player wins, coins drop or credits register like a traditional slot machine.

All other features that are available in a traditional slot machine, i.e. bill validator, personalized card tracking, cash or credit, number of coins played display, are available in present invention.

Figure 5:
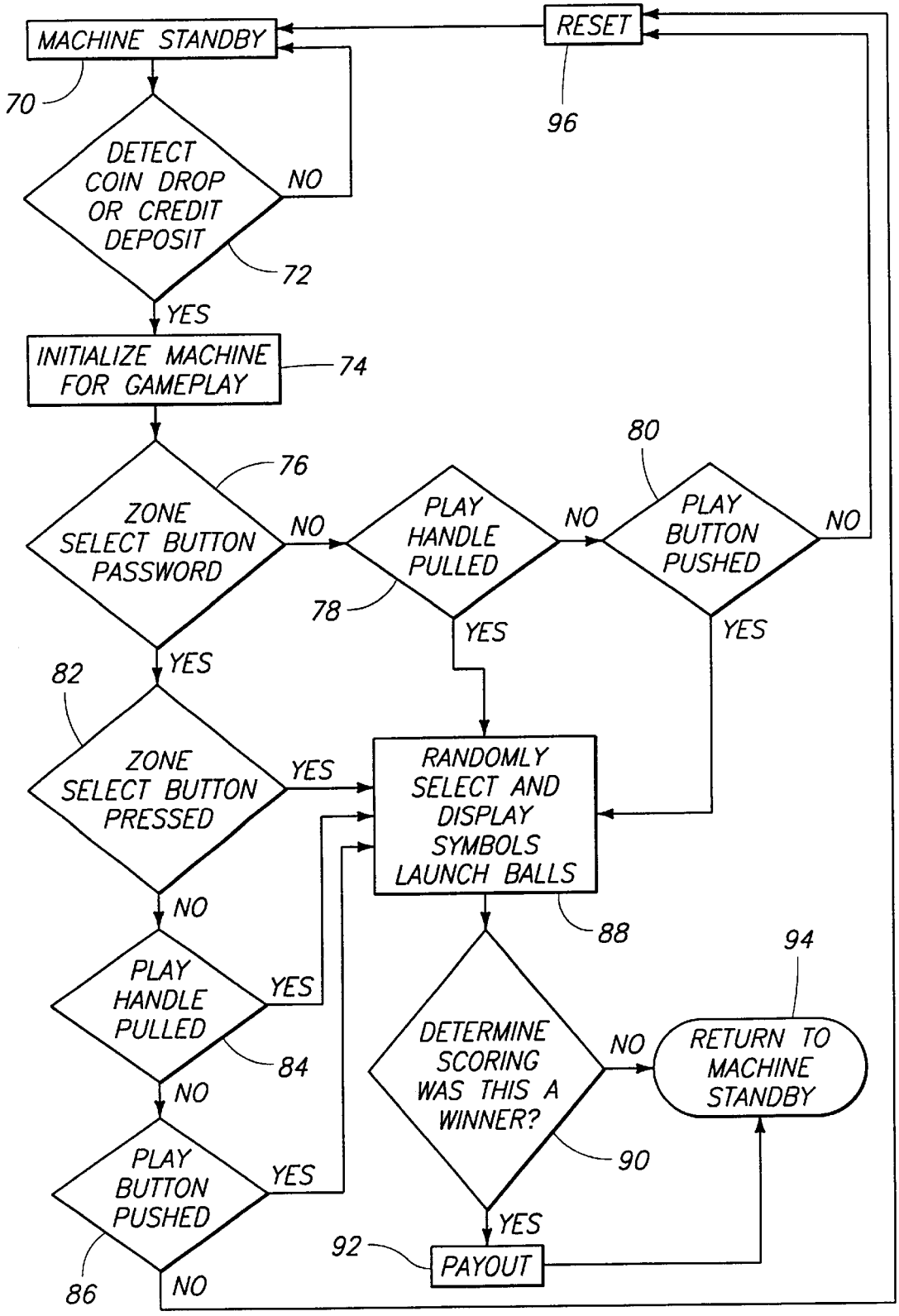
FIG. 5 is a flow chart diagraming the operational sequence of the drop slot game machine of the present invention.

In FIG. 5 the operational sequence of the for the present invention begins with the machine in standby 70. In standby 70 the machine can carry out any number of actions to attract players such as lighting and sound effects. If the machine detects a coin drop or credit deposit 72 the machine is initialized for gameplay 74. Also referring to FIG. 1, when initialized for gameplay 74 the present invention may randomly displays symbols on the exit position symbol display 24, clears the payline display 28, and moves all the zone deflectors 8 to their starting position, either extended or retracted.

Gameplay continues with either the player selecting a drop zone I, II, III, IV when a zone select button is pressed 76 or the machine randomly selecting a drop zone when the play handle is pulled 78 or the play button is pushed 80. As the play handle is pulled 78 or the play button is pushed 80 the selected zone deflector is extended and the balls are launched and the game is played 88. If a drop zone I, II, III, IV was selected when a zone select button is pressed 76 the balls are launched and the game is played 88 with a second pressing of the zone select button 82, the play handle is pulled 78, or the play button is pushed 80.

In the preferred embodiment, the symbols on the exit position symbol display 24 that are to be used for scoring in a game are be selected and displayed simultaneously with the launching of the balls. Alternatively, the symbols on the exit position symbol display 24 may be selected and displayed when the drop zones are selected 76, the play handle is pulled 78, or the play button is pushed 80.

If a coin drop or credit deposit is detected 72 and no further gameplay events occur after a specified amount of time the machine may randomly select a drop zone and play the game 88 or reset 96.

After the balls are launched and the game is played 88 the present invention determines scoring 90. If the game is a winner the invention provides the appropriate payout response 92 and returns the machine to standby 94(70). If the game is not a winner the machine is returned to standby 94(70).

It is within the scope of the present invention to use any number of balls launched one at a time or in groups. It is advantageous to use a smaller number of balls launched simultaneously in order to keep the cycle rate on the game as short as possible. It is also within the scope of the present invention to use balls that have an offset center of mass.

The present invention may also be configured for lottery or pull tab usage in areas where slot machines are prohibited. Any number of balls could be dropped to select any number of randomly selected symbols. The selected symbols would be displayed and any winning combination would be printed out on a validated ticket for redemption.

From the foregoing teachings, it can be appreciated by one skilled in the art that a new, novel, and nonobvious gaming machine has been disclosed. It is to be understood that numerous alternatives and equivalents will be apparent to those of ordinary skill in the art, given the teachings herein, such that the present invention is not to be limited by the foregoing description but only by the appended claims.

We claim:

1. A game machine comprising:

a playing field;

at least one visible element on the playing field to allow the at least one visible element to move upon the playing field;

a plurality of detection positions configured to detect said at least one visible element as it moves to the detection position;

a symbol selector which performs an association between at least one symbol with at least one of said plurality of detection positions, said at least one symbol being selected from a plurality of available symbols, said symbol selector performing said association in a manner which varies from one game to another game; and at least one payline display configured to display at least one symbol which results from the at least one visible element being detected by at least one of said plurality of detection positions.

2. The game machine according to claim 1 wherein there are more than two symbols available for association by said symbol selector to a plurality of said detection positions.

3. The game machine according to claim 1 wherein there are a plurality of symbols associated by said symbols selector to a plurality of said detection positions.

4. The game machine according to claim 1 further comprising a detection position symbol display which is configured to display said at least one symbol in association with said plurality of detection positions.

5. The game machine according to claim 1 wherein there are a plurality of symbols associated by said symbol selector to a plurality of said detection positions; and further comprising an detection position symbol display which is configured to display said plurality of symbols in association with said plurality of detection positions.

6. The game machine according to claim 1 wherein the symbol selector is configured to associate an individually selected symbol with each of said plurality of detection positions.

7. The game machine according to claim 1 wherein the at least one visible element includes a plurality of visible elements played in a game.

8. The game machine according to claim 1 wherein the at least one visible element includes a plurality of visible elements played simultaneously in a game.

9. The game machine according to claim 1 wherein:

the at least one visible element includes a plurality of visible elements which are played in a game; and, said at least one payline display is configured to display a plurality of symbols.

10. The game machine according to claim 1 wherein said at least one payline display is configured to display a plurality of symbols.

11. The game machine according to claim 1 wherein the symbol selector is configured to associate an individually selected symbol with each of said plurality of detection positions; and further comprising a detection position symbol display which is configured to display said individually selected symbol in association with each of said plurality of detection positions.

12. The game machine according to claim 1 wherein the symbol selector is configured to associate at least one randomly selected symbol with each of said plurality of detection positions.

13. The game machine according to claim 1 wherein the symbol selector is configured to in a random manner associate an individually selected symbol with each of said plurality of detection positions; and further comprising a detection position symbol display which is configured to display said individually selected symbol in association with each of said plurality of detection positions.

14. The game machine according to claim 1 wherein the playing field is vertically oriented.

15. The game machine according to claim 1 further comprising at least one zone divider wall operable to divide the playing field into plural drop zones.

16. The game machine according to claim 1 further comprising:

at least one zone divider wall operable to divide the playing field into plural drop zones, at least one zone deflector for controllably deflecting the at least one visible element onto differing drop zones of said plural drop zones.

17. The game machine according to claim 1 further comprising a plurality of deflector pegs upon the playing field which may be encountered to change the path of the at least one visible element during play of a game.

18. A method of operating a game machine comprising:

providing a playing field;

providing at least one visible element on the playing field whereon the at least one visible element moves up the playing field in an apparently random manner;

providing a plurality of detector positions which detect said at least one visible element after movement upon the playing field;

associating at least one symbol with at least one of the plurality of detector positions, said associating being performed in a manner which provides associated symbols from a plurality of available symbols, said associated symbols varying from one game to another game;

detecting the at least one visible element in one or more of the plurality of detector positions;

displaying upon a payline display at least one symbol which results from the at least one visible element being detected in a detector position during play of a game.

19. The method according to claim 18 and further comprising displaying more than two associated symbols upon an exit position symbol display over multiple games.

20. The method according to claim 18 and further comprising displaying the associated symbols upon an exit position symbol display.

21. The method according to claim 18 further comprising dividing at least a portion of the playing field into a plurality of zones.

22. The method according to claim 18 further comprising:

providing a plurality of deflectors upon the playing field; and, encountering the at least one drop with at least one of the plurality of deflectors.

23. The method according to claim 18 wherein said associating is performed to provide a plurality of associated symbols which are associated with a plurality of detector positions.

24. The method according to claim 18 wherein:

said associating is performed to provide a plurality of associated symbols which are associated with a plurality of detector positions; and, said providing at least one visible element includes providing a plurality of visible elements to the playing field during a game.

25. The method according to claim 18 wherein:

said associating is performed to provide a plurality of associated symbols at least one of which is associated with each of the plurality of detector positions; and, said providing at least one visible element includes providing a plurality of visible elements to the playing field during a game.

* * * * *

UNITED STATES PATENT AND TRADEMARK OFFICE

CERTIFICATE OF CORRECTION

PATENT NO. : 6,419,226 B2
DATED : July 16, 2002
INVENTOR(S) : David A. Krise et al.

It is certified that error appears in the above-identified patent and that said Letters Patent is hereby corrected as shown below:

Column 1,
Line 28, delete “sop” and insert -- stop --.

Column 2,
Line 60, delete “furthermore” and insert -- Furthermore --.

Column 4,
Between lines 13 and 14, insert -- Detailed Description of the Invention --.
Line 19, delete “sot hat” and insert -- so that --.
Line 45, delete “chose” and insert -- choose --.

Column 5,
Line 31, after the words “sequence of” delete the words “the for”.
Line 38, delete the word “displays” and insert -- display --.
Line 56, after the word “are” insert -- to --.

Column 6,
Line 55, after the word “comprising” delete “an” and insert -- a --.

Signed and Sealed this

Tenth Day of February, 2004

JON W. DUDAS
*Acting Director of the United States Patent and Trademark Office*